United States Patent [19]

Glesmann

[11] 4,007,860

[45] Feb. 15, 1977

[54] METHOD AND APPARATUS FOR MAKING BOWS

[75] Inventor: Herbert C. Glesmann, Omaha, Nebr.

[73] Assignee: Ward Paper Box Company, Kansas City, Kans.

[22] Filed: Dec. 15, 1975

[21] Appl. No.: 640,898

[52] U.S. Cl. ..... 223/46

[51] Int. Cl.[2] ..... A41H 43/00

[58] Field of Search ..... 223/1, 46; 112/252

[56] References Cited

UNITED STATES PATENTS

| | | | |
|---|---|---|---|
| 2,933,223 | 4/1960 | Kravig et al. | 223/46 |
| 3,223,299 | 12/1965 | Kerrigan et al. | 223/46 |
| 3,338,483 | 8/1967 | Thayer | 223/46 |
| 3,464,601 | 9/1969 | Christensen | 223/46 |
| 3,485,422 | 12/1969 | Egid | 223/46 |

*Primary Examiner*—G. V. Larkin

*Attorney, Agent, or Firm*—Schmidt, Johnson, Hovey & Williams

[57] ABSTRACT

A method and apparatus for making ribbon bows of conventional looped configuration, the apparatus comprising a feeder assembly for delivering a length of ribbon; a winding mechanism for receiving the length of ribbon and for winding said lengths into an extended helix; an assembly for gathering the extended helix at substantially the horizontal center line thereof whereby to initially define the loops of the bow, there being means for securing the loops at their point of gathering whereby to create the finished bow. The aforementioned apparatus is operated automatically in timed sequence whereby to carry out the method of forming a ribbon bow, the method including the steps of feeding a length of ribbon to the winding mechanism, winding the length into an extended helix, lying in a generally horizontal plane, gathering the extended helix at substantially the horizontal center line thereof whereby to initially define the loops of the bow and then securing the loops together at their center point whereby to create the finished bow, the finished bow being delivered from the machine in a fully completed and ready to use condition.

30 Claims, 15 Drawing Figures

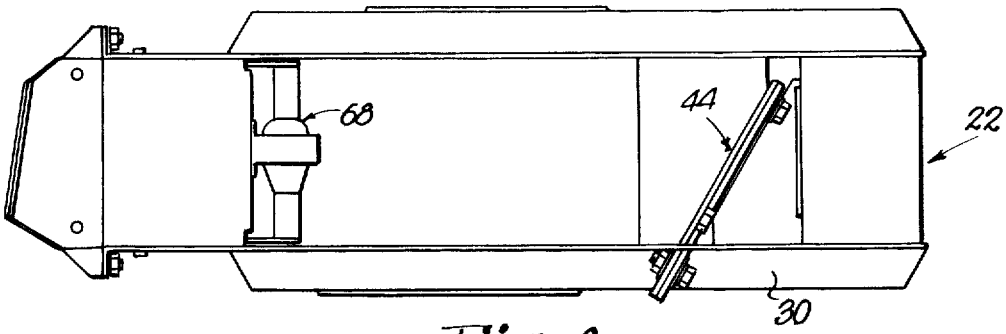
Fig. 6.
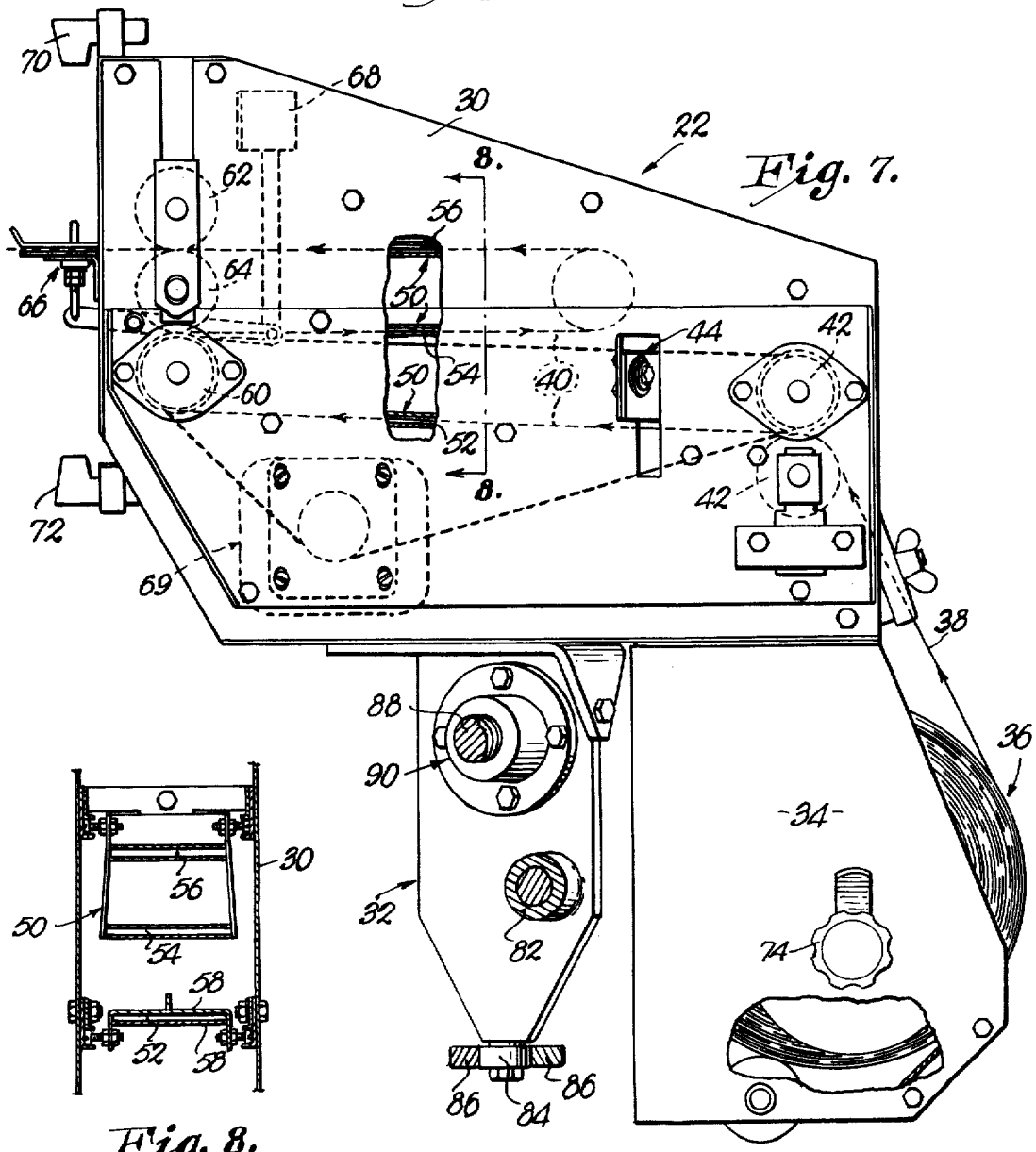
Fig. 7.
Fig. 8.

METHOD AND APPARATUS FOR MAKING BOWS

The method and apparatus hereinafter described relates to the fabrication or formation of a decorative ribbon bow from ribbon material which is relatively stiff in character, the form of the invention illustrated being utilized to make a bow which has four loops and a pair of free ends.

It is an important object of this invention to provide apparatus for making a ribbon bow which includes an assembly for feeding a predetermined length of the ribbon from a supply spool to a winding mechanism, which winding mechanism is rotated whereby to form the length of ribbon into an extended helix, there being a gathering assembly, including a pair of gathering forks, for gathering the extended helix of ribbon at substantially the horizontal center line thereof, while the helix is retained by the winding mechanism, such gathering serving to initially define the loops of the bow, the loops then being secured at substantially their center point by suitable securing means whereby to create the finished bow which is then delivered from the apparatus.

Yet another object of this invention is to provide a method for making ribbon bows, utilizing the disclosed apparatus, and which method is fully automatic and includes a plurality of sequentially occurring steps whereby a predetermined length of ribbon is automatically fabricated into a finished bow which is ready for use.

Another object of the invention is to provide, in the apparatus, a feeder assembly which is mounted adjacent the winding mechanism, the feeder assembly being reciprocable in a horizontal path with respect to the winding mechanism and serving to drive such mechanism as it reciprocates through a suitable drive train, the feeder assembly carrying a spool of ribbon and having means for automatically delivering a length of ribbon from the spool to the winding mechanism, such means including a chute for guiding the ribbon from the spool to the winding mechanism, driven rollers for initially urging one end of the ribbon from the spool toward the winding mechanism, and severing means for cutting the ribbon within the feeding mechanism whereby a predetermined length of the ribbon may be delivered to the winding mechanism.

Another important object of this invention is to provide winding mechanism for creating an extended helix of ribbon while it is delivered to the winding mechanism, the winding mechanism being disposed proximal to the feeder assembly and including a plurality of simultaneously rotatable arms for receiving the length of ribbon and forming the same into the extended helix.

Another significant object is to provide, in the winding mechanism, pads carried at the inner ends of each of the rotatable arms, the pads retaining the length of ribbon as it is wound into the extended helix, there being means for shifting the arms and, therefore, the pads, from a first helix retaining position to a second bow releasing position subsequent to formation of the extended helix and gathering thereof by the gathering assembly.

Yet another important object is to provide, in proximal relationship to the winding mechanism, an assembly for gathering the extended helix of ribbon which has been formed by the winding mechanism, such gathering assembly including a carriage mounted on the same framework which carries the feeder and the winding mechanism, the carriage being movable to position the same adjacent the extended helix and having a pair of movable gathering forks carried thereby, whereby said gathering forks may be driven toward one another to gather the extended helix at substantially the horizontal center line thereof whereby to initially define the bow.

Another object is to provide means for securing the loops of the bow after they have been gathered, such securing means being operably associated with the gathering means and in the form of a stapler which secures the loops of the bow together at their point of gathering whereby to create the finished bow, the gathering assembly then delivering the bow from the machine in its complete and finished condition.

Other objects include details of construction such as the drive mechanism for the major components of the apparatus, the means by which the operations of the apparatus are sequentially timed, whereby to render the same fully automatic in its operation, and other details of construction which will become apparent from the following specification and accompanying drawings.

FIG. 6 is a top plan view of the feeder assembly;

FIG. 7 is a side elevational view of the feeder assembly, parts being broken away and in dashed lines to illustrate details of construction;

FIG. 8 is a view taken along line 8—8 of FIG. 7;

In view of the time-consuming hand labor involved in the usual fabrication of a decorative ribbon bow, efforts have been made to develop apparatus and methods for fabricating such bows automatically and at high rates of production, particularly since such bows have enjoyed wide popularity in gift wrapping and similar decorative uses, not only by individuals but in multiple commercial applications. Past efforts to develop machinery for automatically making decorative bows are exemplified, for instance, by Kravig, U.S. Pat. No. 2,933,223, issued Apr. 19, 1960, and relating to such apparatus, as well as Kravig, U.S. Pat. No. 3,112,240, issued Nov. 26, 1963, and relating to the bows which may be formed by such machinery.

In the present instance, the apparatus and method hereinafter described are particularly intended for fabricating a decorative bow having four loops and a pair of free ends, the bow being made from a relatively stiff ribbon material. The bows, in finished condition, are utilized for commercial decorative purposes such as on gift packages, although it will be readily appreciated that the finished bows could be individually sold as a decorative item.

It is, of course, desirable that such bows be produced at high speeds by the apparatus, thereby reducing the cost of such bows due to savings in the utilization of manual labor, and it is also desirable that the finished bows have a consistent style and finished condition. To this end, the apparatus hereinafter described is fully automatic in its operation, the same operating on a timed sequence whereby a length of ribbon fed to the apparatus is rapidly fabricated into a finished bow, which bow is ready for use without any hand labor being necessary with respect to the fabrication thereof.

Figure 15:
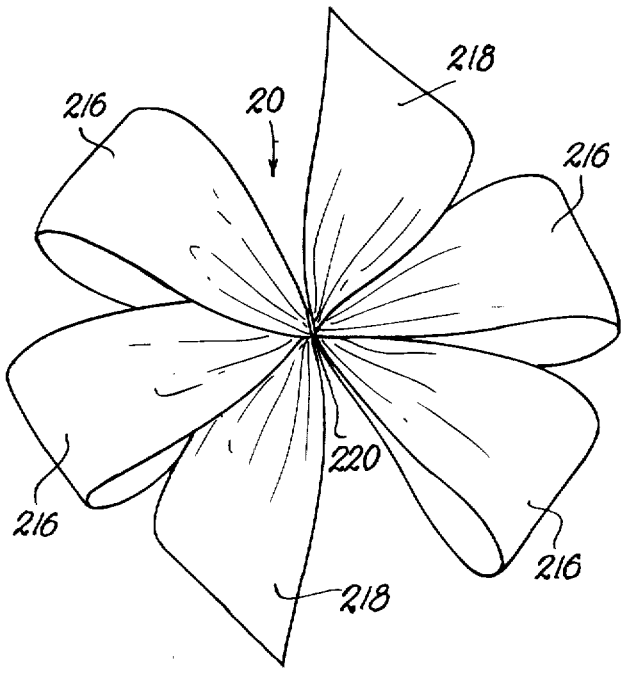
FIG. 15 is a perspective view of the finished ribbon bow.

The bow, such as is fabricated by the method and apparatus hereinafter described, is shown, in its finished condition, in FIG. 15 of the drawings and has been broadly designated by the numeral 20.

Figure 2:
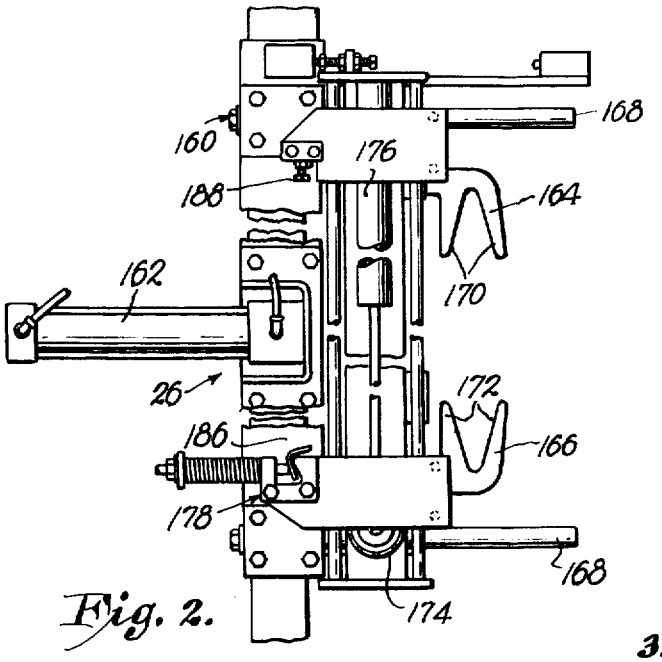
FIG. 2 is a fragmentary, top plan view of the gathering assembly of the apparatus.
Figure 1:
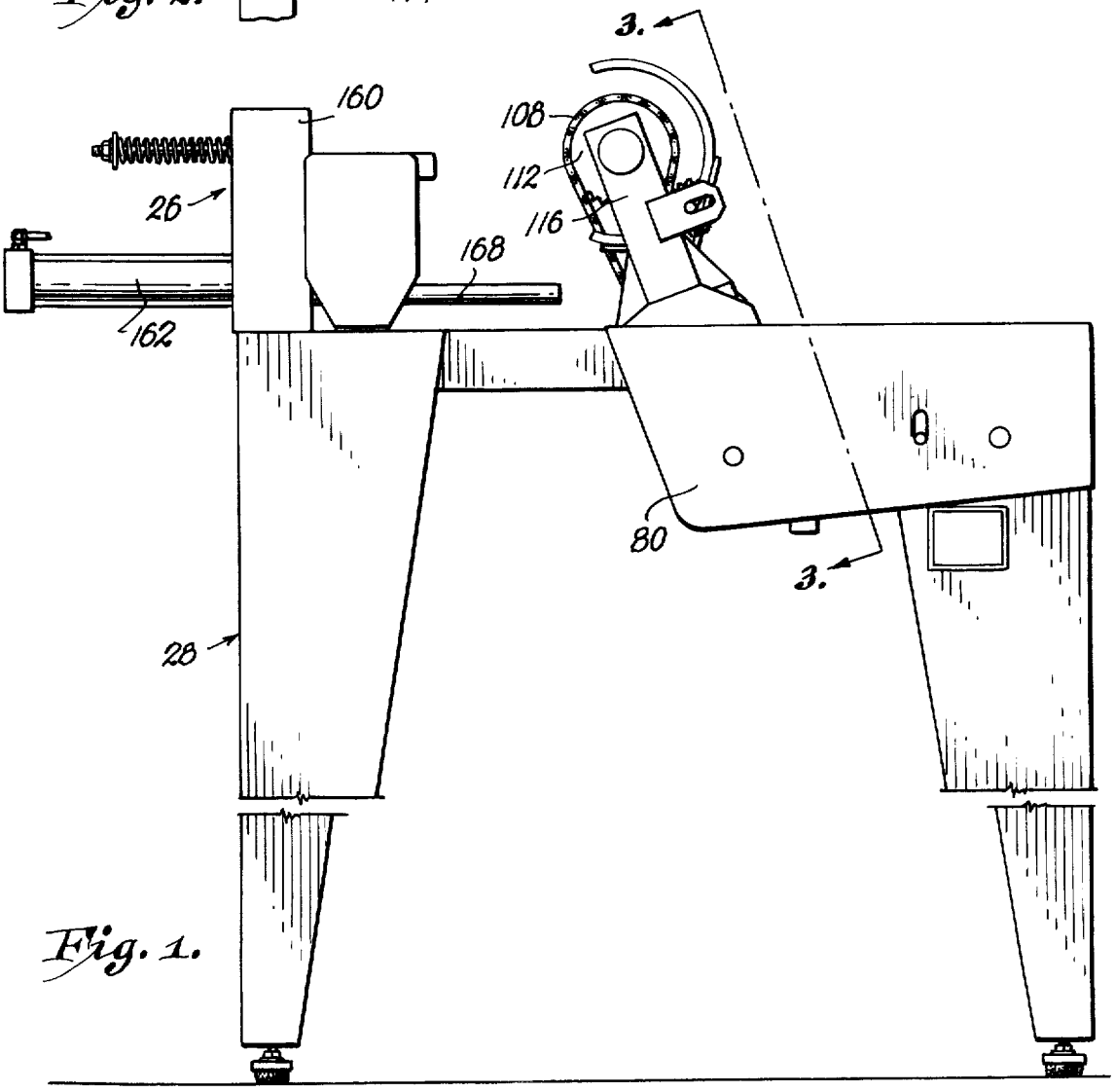
FIG. 1 is a fragmentary, side elevational view of the apparatus.
Figure 12:
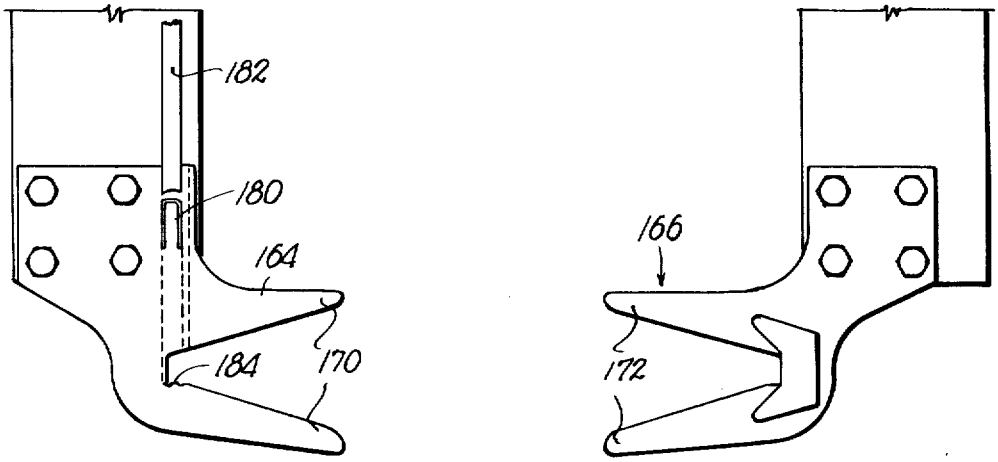
FIG. 12 is an enlarged, fragmentary top plan view of the gathering forks.
Figure 13:
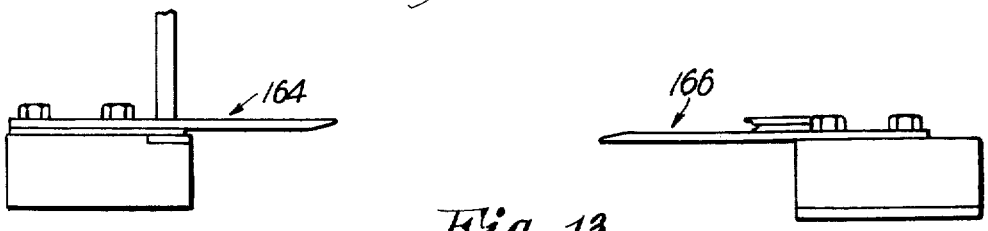
FIG. 13 is a front elevational view of the gathering forks in an open condition.

The apparatus for making the ribbon bow 20 constitutes a single piece of machinery, such machine having three basic components, namely, a feeder assembly 22, which feeder assembly is primarily illustrated in FIGS. 5, 6, 7 and 8; a winding mechanism, broadly designated by the numeral 24, and which is primarily illustrated in FIGS. 1, 3, 4, 9, 10 and 11; and a gathering assembly, which is a part of the overall machine, such assembly being primarily designated by the numeral 26, and primarily illustrated in FIG. 2, 12 and 13. The aforementioned major components of the bow-making apparatus, namely the feeder assembly 22; the winding mechanism 24; and the gathering assembly 26 are all operably interconnected and controlled by suitable timing components and mechanism whereby they operate in controlled and timed sequence to fabricate a finished ribbon bow from a length of ribbon. The various aforementioned major components are all mounted upon a suitable stand 28 which supports the entire bow-making apparatus, and such components are disposed in a cooperative operating relationship, the overall machine as it is viewed from the front thereof for instance, first presenting the feeder assembly which is disposed in front of the winding mechanism, and then, the gathering assembly which is disposed rearwardly of the winding mechanism.

Figure 14:
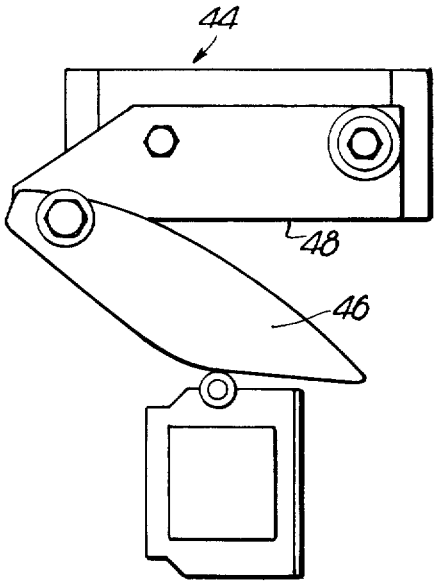
FIG. 14 is an elevational view of the ribbon severing knife.

First, considering the feeder assembly 22 and referring particularly to FIGS. 5–8 of the drawings, as well as associated FIG. 14, it will be noted that the feeder assembly includes a casing 30, the casing being carried in a generally vertical position by a feeder assembly mounting plate 32, which plate 32 is disposed angularly with respect to the feeder assembly 22 whereby such assembly is presented at a slight angle with respect to the winding mechanism 24 for purposes which will hereinafter become apparent.

A ribbon supply carrier 34 depends from the casing 30 of the feeder assembly 22 and carries therewithin a suitably adjustable, rotatable position, a spool 36 of ribbon, which spool presents a length of ribbon 38, which length is fed into and through the feeder assembly 22 and ultimately to the winding mechanism 24 where it is wound into an extended helix by means which will be hereinafter described.

However, in delivering or feeding the length of ribbon 38, which constitutes the free end of the ribbon emanating from the supply spool 36, the length of ribbon follows the delivery path defined by the dashed lines and arrows 40 in FIG. 7 of the drawings. Thus, it will be noted that the ribbon first passes between a pair of driven rollers 42 which serve to pull the length of ribbon 38 from the supply spool 36 and urge it into the feeder assembly 22. In its early path of travel the length of ribbon 38 passes through severing means 44, such severing means being illustrated in detail in FIG. 14 of the drawings and comprising a swingable knife 46 which cooperates with a cutting edge 48 whereby to sever a predetermined length of ribbon upon actuation of suitable control mechanism.

The length of ribbon 38, after passing through the open severing means 44, is guided by a chute 50 which has an initial lower path 52, an intermediate path 54, and a normally upper path 56, the chute being best shown in FIG. 8 of the drawings and comprising, in each of its paths, a pair of spaced-apart plates 58 which define therebetween the respective paths 52, 54 and 56 of chute 50, the ribbon passing along such paths as it is urged thereinto by driven rollers 42. In this regard, it should be noted that the ribbon utilized is of sufficient stiffness that it may be urged along said paths by the driven rollers 42, there being additional drive rollers at the end of feeder assembly 22 opposite to those carrying rollers 42 such as, for instance, drive roller 60 and driven rollers 62 and 64. The drive roller 60 urges the length of ribbon 38 from its lower path 52 along chute 50 into its intermediate path 54, the ribbon then passing along uppermost path 56 and between the driven rollers 62 and 64. After passing between rollers 62 and 64, the free end of the length of ribbon 38 passes out of the feeder assembly 22 through guide means 66, which guide means are operable to act as a drag brake to control the speed of delivery of the ribbon length 38 from the feeder assembly 22 to the winding mechanism 24, for purposes which will hereinafter become apparent.

A solenoid 68 is carried atop feeder assembly 22 and, upon suitable actuation, serves to move driven rollers 62 and 64 apart so that, as the length of ribbon 38 is drawn from the feeder assembly 22 by virtue of its engagement with the winding mechanism 24, said rollers 62 and 64 will not act upon the ribbon and it will be drawn from the feeder assembly 22 at a rate of speed to be determined by the winding mechanism 24 and tensioned with respect thereto by drag brake guide means 66, it being noted from FIG. 7 that as solenoid 68 and its associated linkage are activated to shift rollers 62 and 64 apart, it also serves to simultaneously close the drag brake 66 and thereby place the same in frictional engagement with the length of ribbon 38 as it is being drawn from the feeder assembly 22 by the winding mechanism 24.

Figure 5:
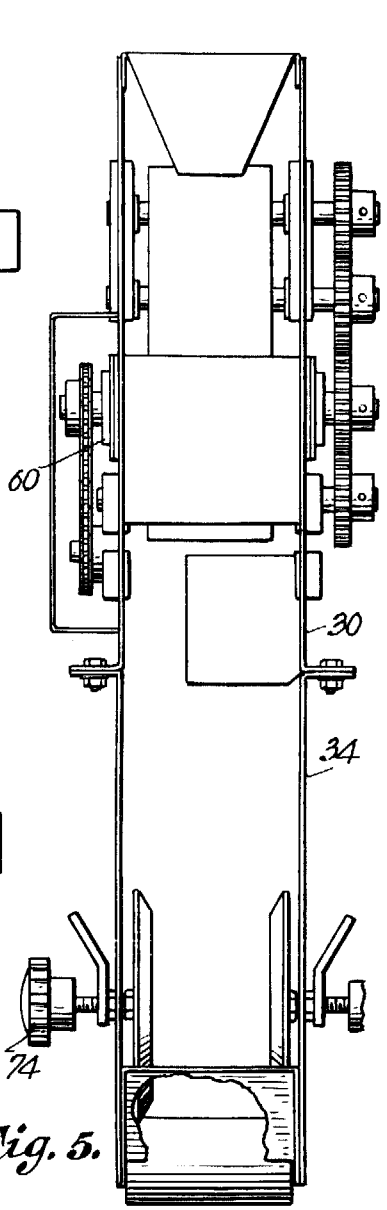
FIG. 5 is a front elevational view of the feeder assembly.
Figure 3:
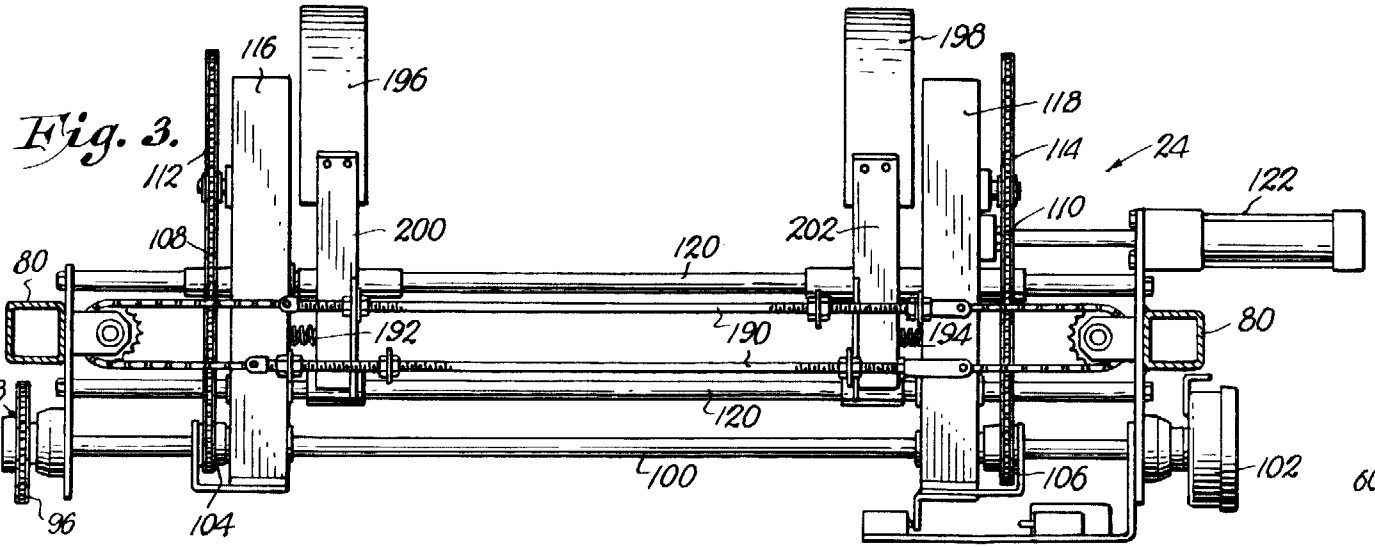
FIG. 3 is a view taken along line 3—3 of FIG. 1.

A suitable power source 69, for driving the various components of the feeder assembly 22 and specifically upper roller 42 and roller 60, is carried within the casing 30 of the feeder assembly 22, in the lower portion thereof. As is illustrated in FIG. 5 of the drawings, the driving roller 60 is coupled with driven rollers 62 and 64 by suitable gearing, and upper driven roller 42 is coupled with the lower driven roller 42 by suitable sprocket and chain mechanism whereby power imparted to upper roller 42 and driven roller 60 by the power source may be subsequently delivered to the lower driven roller 42 and the driven rollers 62 and 64, all in a manner clearly shown in FIGs. 5 and 7 of the drawings.

The feeder assembly 22 carries, at the forwardmost portion thereof, that is the area adjacent the winding mechanism 24, an upper electric eye 70 and a lower electric eye 72, said eyes being positioned to read the length of ribbon 38 as it passes from the feeder assembly 22 and toward the winding mechanism 24, for purposes which will be hereinafter made apparent.

It should be noted, with respect to feeder assembly 22, that the arrangement of the chute 50 may be altered whereby to accommodate a length of ribbon of any desired configuration or longitudinal dimension, and particularly the intermediate and upper paths of the chute 50 may be reciprocated whereby to enlarge the overall length of the chute and thus accommodate a ribbon of greater length. Likewise, the spool carrier 34 may be made of any size whereby to receive a spool of ribbon of greater diameter if such is desired, and the spool carrier is provided with suitable locating means such as 74, which are manually adjustable to readily accommodate and properly position the spool of ribbon 36 which is carried by carrier 34. In initially charging the apparatus with a length of ribbon, a free end is drawn from the spool 36 and manually fed into the feeder assembly 22 by inserting such free end between rollers 42 which, being driven, will then serve to move the length of ribbon along the paths of the chute 50 as hereinabove described, whereby the free end ultimately passes from the feeder assembly through the drag brake guide means 66 and is driven toward the winding mechanism 24.

Figure 4:
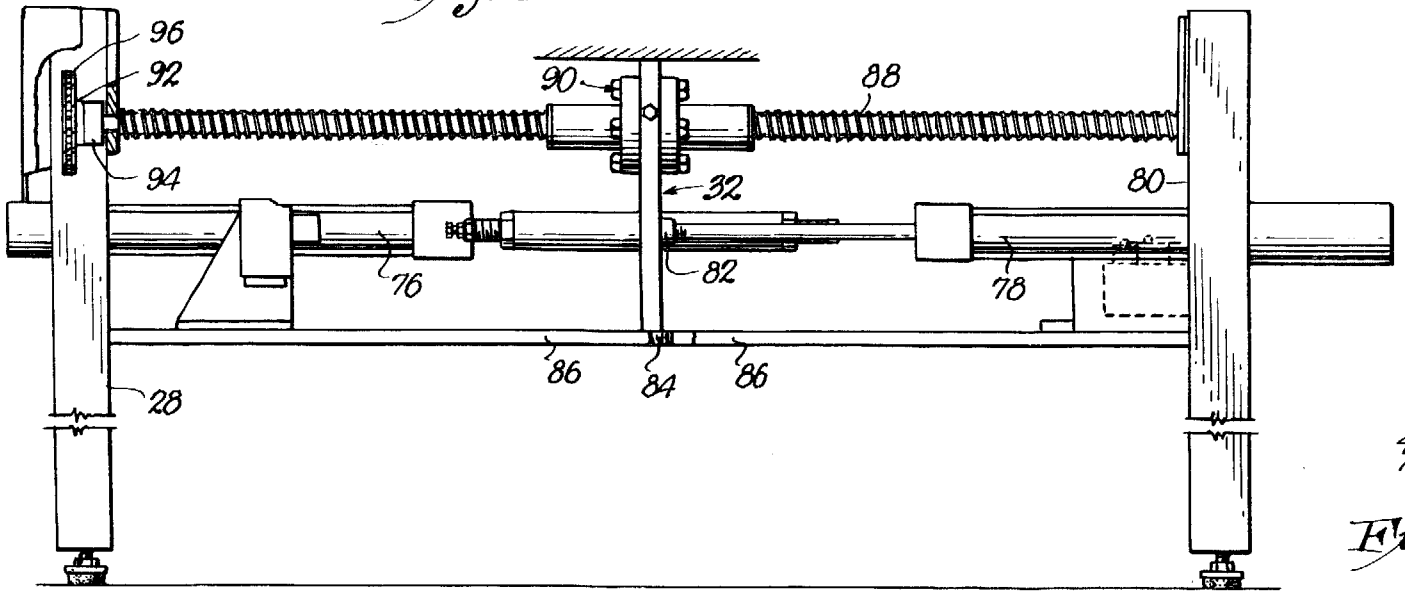
FIG. 4 is a fragmentary, front elevational view of the drive means for the feeder assembly and the winding mechanism.

The feeder assembly 22 is supported by mounting plate 32 in such a manner as to be reciprocated longitudinally with respect to the winding mechanism 24. To effect such a reciprocation in a horizontal path with respect to the winding mechanism there are provided power means for moving the feeder assembly in such path, such power means including a pair of air cylinders 76 and 78 which are carried by the framework 80 of the apparatus, as best shown in FIG. 4 of the drawings, said air cylinders 76 and 78 each having the free end of their respective rods coupled with the mounting plate 32 as by being screwed into a corresponding boss 82, such as shown in FIG. 7 of the drawings. As is apparent, upon actuation of a selected cylinder 76 or 78, the mounting plate 32 will be driven in a generally horizontal path and in the desired direction and thus also cause the movement of feeder assembly 22 in a horizontal path with respect to the winding mechanism 24.

The lower end of mounting plate 32 has a roller 84 thereon which rides within a trackway 86 whereby to guide the movement of the mounting plate 32 and therefore feeder assembly 22, said trackway 86 extending from one side to another of the stand 28 which carries the apparatus.

Also associated with the mounting plate 32 is a drive screw 88 which extends the full distance between the framework 80 of the apparatus in the manner shown in FIG. 4 for instance, and passes through a suitable ball bearing nut 90 carried by mounting plate 32. As is apparent, when the mounting plate is driven in its horizontal path of reciprocation, such movement will cause corresponding rotation of drive screw 88, whereby the drive screw will be rotated as the mounting plate 32 is activated and driven by the power means 76 and 78. Drive screw 88, being so powered, is then utilized, through provision of a suitable power train, to drive other components of the apparatus in a manner which will be hereinafter described.

The power train includes a sprocket 92 at one end of the drive screw 88 which is driven through an overrunning clutch 94 carried by said drive screw 88 and as illustrated in FIG. 4. Drive screw 88 is connected through a chain 96 which is carried by sprocket 92 with a sprocket 98 at one end of a countershaft 100. The countershaft 100 spans the distance between the sides of the framework 80 which carries the apparatus, the countershaft being appropriately journaled for rotation and provided with an electric brake as at 102 to prevent coasting of the countershaft 100.

The countershaft is provided with a sprocket 104 adjacent one end thereof and another sprocket 106 adjacent the other end thereof. Chains carried by said sprockets and designated 108 and 110 respectively, pass over corresponding drive sprockets 112 and 114 respectively at the opposite ends of the winding mechanism 24, all to the end that power generated by rotation of the driven screw 88 may ultimately be transmitted, through the above described power train, to the winding mechanism to thereby drive such mechanism upon rotation of the screw 88 in one direction, as controlled by overrunning clutch 94, whereby countershaft 100 is correspondingly driven.

The sprockets 112 and 114 are carried by movable spindle assemblies 116 and 118 respectively which are disposed at the opposite ends of the winding mechanism 24. The spindle assemblies are each movably supported by a pair of track members 120 whereby the spindle assemblies may be moved in a longitudinal, reciprocating path as by an air cylinder 122, all as will be hereinafter explained in greater detail.

Each of the spindle assemblies 116 and 118 carries a rotatable shaft 124 and 126 respectively, which shafts are driven through their corresponding sprockets 112 and 114. Shaft 124 carries a pair of arms 128 and 130, and shaft 126 carries a similar pair of arms 132 and 134 as shown in FIG. 9, all of said arms 128–134 being simultaneously rotatable upon being driven by their corresponding shafts 124 and 126 through the actuation of drive screw 88 and the power train above described.

Figures 9, 10, 11:
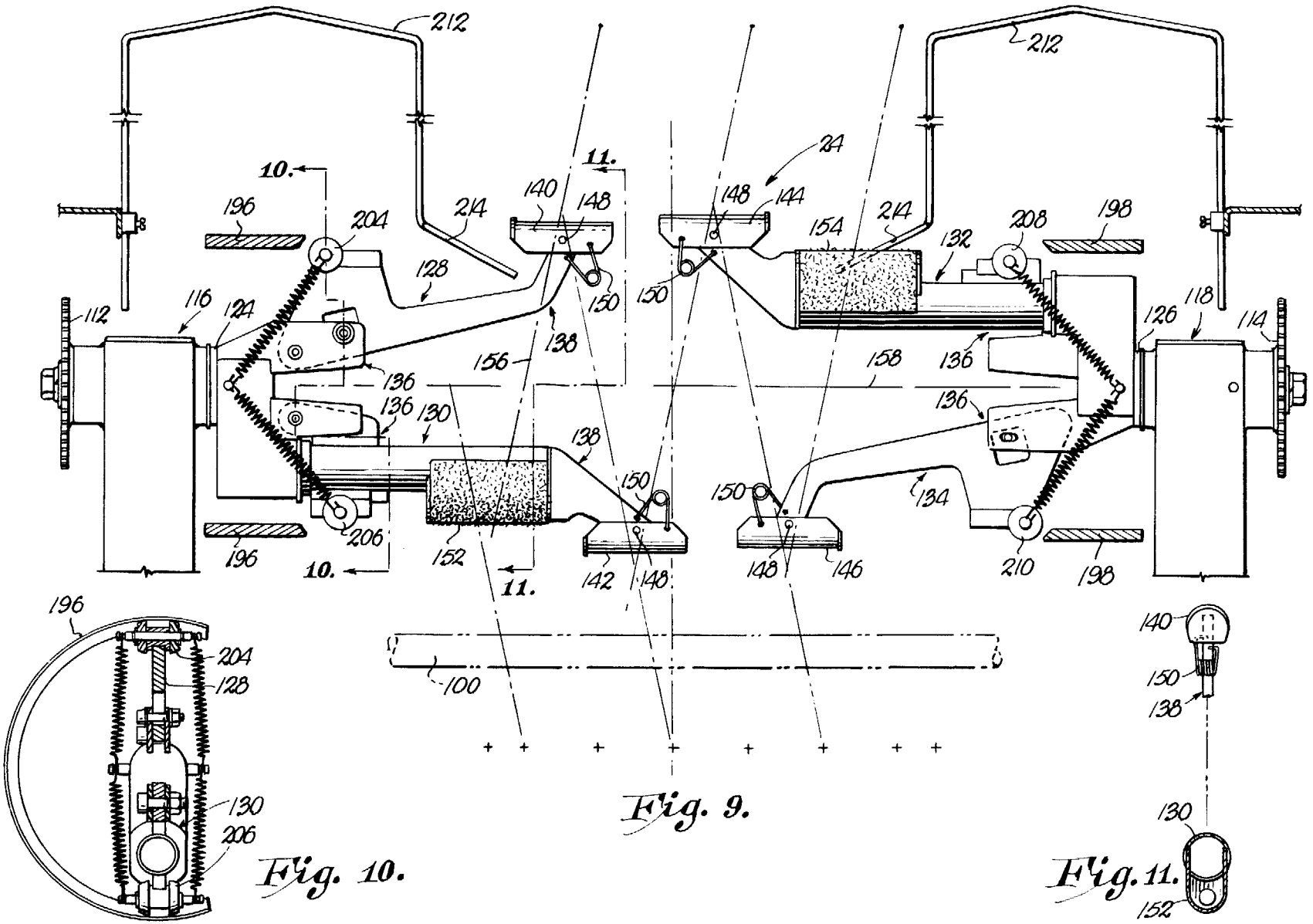
FIG. 9 is a front elevational view showing the major portion of the winding mechanism.
FIG. 10 is a sectional view taken along line 10—10 of FIG. 9.
FIG. 11 is a view taken along line 11—11 of FIG. 9.

Each of the arms 128–134 has at its outer end 136, that is the end thereof adjacent corresponding spindle assemblies 116 and 118 respectively, means pivotally coupling said arms with their corresponding shafts 124 and 126 respectively whereby said arms 128–134 may be shifted with respect to their shafts 124 and 126 respectively, in an inward direction viewing FIG. 9, for instance.

The inner ends 138 of each of the arms 128–134 each have a swingable pad 140, 142, 144 and 146 respectively, mounted thereon, each of said pads 140–146 being swingable with respect to the inner end 138 of its corresponding arm by virtue of the provision of a pivot pin 148 provided for each of the pads 140–146. Associated with each swingable pad 140–146 is a spring 150, which spring is suitably positioned and biased whereby to urge each of the pads 140–146 into an initially substantially horizontal plane as illustrated in FIG. 9 of the drawings.

Arms 130 and 132 are each provided with a vacuumoperated retaining seat 152 and 154 respectively, the seats 152 and 154 being in the nature of a screened area so that a vacuum may pass therethrough, there being a felt cover provided for said seats 152 and 154 so that said seats may be utilized to grip the length of ribbon 38 as it is initially delivered to the winding mechanism, in the case of seat 152, and as winding of the extended helix is completed, in the case of seat 154. A suitable vacuum pump (not shown) is associated with the apparatus, and a vacuum passage is provided through arms 130 and 132 which carry the seats 152 and 154, said vacuum path extending through the outer ends of said arms, through shafts 124 and 126 respectively, and thence through corresponding spindle assemblies 116 and 118 to a suitable vacuum pump, all to the end that a vacuum may be pulled through the seats 152 and 154.

It will be appreciated from the foregoing that, upon actuation of the drive screw 88, which is accomplished when cylinder 76 is activated for instance, to drive the feeding assembly 22 from left-to-right to commence fabrication of the bow, the sprocket 92 is driven as a result of the rotation of screw 88 this, in turn, driving countershaft 100, which, in turn, imparts rotary motion to sprockets 112 and 114 and thence to shafts 124 and 126 respectively, all to the end that the arms 128–134 are rotated in a circular path and in a generally horizontally disposed path. Accordingly, once the apparatus is activated as operation of the feeding assembly is commenced, the winding mechanism 24 will likewise commence rotation.

It will, therefore, be appreciated that as a length of ribbon, such as 38, is delivered from the feeder assembly 22 and toward the winding mechanism 24, the free, outwardly extending end of the ribbon will be delivered to a point where it is in the path of rotation of the arms 128–134 and also, and more particularly, vacuum seat 152. With the end of the ribbon so disposed and rotation of the winding mechanism 24 commencing, the seat 152 will sweep under the free end of the ribbon which is protruding from the feeder assembly and, by virtue of the vacuum being pulled through seat 152, such free end will be grasped by the seat 152. It should also be noted that at the time the free end of the ribbon is grasped by seat 152, the solenoid 68 has been activated, thereby separating rollers 62 and 64; the severing means 44 have been activated, thus creating a free length of ribbon within the feeder assembly 22; and also drag brake guide means has been actuated whereby to place a tension upon the length of ribbon as it is drawn from the feeder assembly 22 by the winding mechanism 24.

As noted, the feeder assembly is driven from left-to-right, viewing the drawings, as the length of ribbon is directed from the feeder assembly 22 to the winding mechanism 24. This causes the length of ribbon to assume the configuration or position of an extended helix, generally illustrated by the dashed lines 156 in FIG. 9 of the drawings, such delivery of the length of ribbon to the winding mechanism, in its helix condition, being aided by the fact that the feeding assembly 22 is angularly positioned with respect to the winding mechanism 24, this being accomplished by virtue of the position of mounting plate 32 which carries the feeder assembly 22.

It will also be appreciated that as the length of ribbon is withdrawn from the feeder assembly by virtue of being grasped by seat 152, and as the arms 128–134 continue their rotation with the feeder assembly traversing horizontally thereacross, the length of ribbon will be passed over first pad 140 of arm 128; thence pad 142 of arm 138; thence pad 144 of arm 132; and then pad 146 of arm 134. After being passed over the pads as aforementioned, this being accomplished as the pads are rotated and swept under the ribbon as it is being fed to the winding mechanism, the trailing end of the ribbon, that is the portion still remaining within the feeder assembly 22 is being acted upon by drag brake 66 to thereby tension the length of ribbon with respect to the winding mechanism 22. Lastly, and in the winding of the helix, the rearmost free end of the length of ribbon, as it emanates from feeder assembly 22, is grasped by vacuum seat 154 to thereby wholly retain the length of ribbon in the form of an extended, essentially flattened helix, the helix having an overall front-to-back width essentially corresponding to that of the pads 140–146 and as best illustrated in FIG. 11 of the drawings.

After the ribbon has been wound into an extended, generally flattened helix in the manner described above, the gathering assembly 26 is automatically activated whereby to ultimately gather the helix of ribbon at substantially the horizontal center line thereof, as indicated by the line 158 in FIG. 9 of the drawings to thereby define the loops of the bow.

The gathering assembly 26, best shown in FIGS. 2, 12 and 13 of the drawings, includes a movable carriage 160 which is driven by an air cylinder 162 whereby the carriage may be shifted from its retracted position, as shown in FIG. 2, to a forward position to thereby dispose a pair of opposed, spaced gathering forks 164 and 166 in alignment with the wound helix of ribbon. The carriage moves forwardly on trackways 168 under the urging of air cylinder 162, which is sequentially operated to control the movement thereof so that it moves forwardly once the helix has been completely wound. It should be noted that, prior to the forward movement of the gathering assembly 26, the arms 128–134 have stopped rotating; the winding of the helix having been completed. The arms, when they have stopped rotating, are generally in a vertical position such as, for instance, shown in FIG. 9 of the drawings, and there is sufficient space adjacent the outer ends 136 of each pair of arms to permit the forks 164 and 166 to move forwardly to a position essentially lying between said outer ends 136 of each of the pair of arms, all to the end that the forks 164–166 may move toward each other and gather the helix or ribbon at substantially the horizontal center line 158 of the wound helix.

Once gathering assembly 26 is moved forwardly to the position above described, the gathering forks 164 and 166 are moved inwardly; that is, toward each other, whereby to grasp or gather the ribbon between the jaws 170 and 172 of the gathering forks 164 and 166 respectively. The forks 164 and 166 are driven toward each other by means of a chain drive 174, which chain drive is activated by a cylinder 176 as illustrated in FIG. 2 of the drawings. As is apparent, activation of cylinder 176 causes driving of the chain 174 and this results in the forks moving toward one another and grasping or gathering the ribbon to a constricted condition adjacent its center. As this occurs, the helix is being maintained in its wound position upon pads 140–146 and thus the four loops of the bow, in the embodiment of the invention chosen for illustration, are initially formed inasmuch as a tension is created, drawing the ribbon together at its center, while the pads 140–146 retain the outer ends of the loops of the bow which is being formed. It should be noted however, in order to maintain such tension, the pads 140–146 will, as the bow is gathered at its center, all tip inwardly, viewing FIG. 9, about their pivot points 148. Also, and essentially concurrently with the gathering of the helix and the tipping of pads 140–146, arms 128–134 will move slightly in an inward direction, all due to the tension created on the loops of the bow as they are being formed through gathering of the helix at its center point by forks 164 and 166.

A bow-securing means is associated with the gathering assembly 26, this being in the form of a stapler 178 carried adjacent gathering fork 166, as shown in FIGS. 2 and 12, the stapler including a magazine 180 which carries a supply of staples, a plunger 182 for driving a staple from the magazine, and an anvil 184 as a part of fork 164 whereby to close the staple as it is driven from the magazine and about the center of the extended helix which has been gathered by forks 164 and 166. A tripping lever 186 is activated by a stop screw 188 as the forks 164 and 166 reach their closed condition whereby to cause the gathered center of the bow to be secured in such condition by means of a staple.

After the bow has been gathered and stapled, and the various components of the apparatus are in the condition described above, it is then necessary to remove the finished bow from the winding mechanism and, more particularly, from its position of retention upon the pads 140–146 of arms 128–134 respectively.

To accomplish final removal of the bow from the winding mechanism, the spindle assemblies 116 and 118 are retracted away from each other by means of an air cylinder 122 which is coupled with the spindle assembly 118. Thus, said cylinder is sequentially activated once gathering and stapling of the bow has been completed and, when so activated, serves to move the spindle assemblies 116 and 118 and their associated arms and pads away from each other; that is apart, viewing FIGS. 4 and 9 for instance, to aid in the release of the bow from the winding mechanism.

The activation of cylinder 122 and consequent movement of the spindle assemblies 116 and 118 also results in driving of a rod and chain drive assembly 190, best shown in FIG. 4 of the drawings, which assembly not only serves to move the spindle assemblies apart, but to also permit a pair of springs 192 and 194 to urge corresponding semicylindrical cams 196 and 198 toward each other, viewing the drawings. As the cams are moved toward each other in the manner above described, the cams also being carried by track means 120 through upstanding members 200 and 202 respectively, the cam 196 will simultaneously engage rollers 204 and 206 carried at the outer ends of arms 128 and 130 respectively, and cam 198 will simultaneously engage rollers 208 and 210 carried at the outer ends of arms 132 and 134 respectively, causing all of said arms 128–134 to shift inwardly; that is, toward center line 158 which extends longitudinally through the mechanism 24 as shown in FIG. 9 of the drawings. Thus, the spindle assemblies and the arms carried thereby are retracted or withdrawn from the helix substantially concurrently with the inward collapsing of the arms through the movement of cams 196 and 198, this collective action permitting the gathering assembly 26 to fully remove the finished bow from the winding mechanism and to carry it rearwardly therefrom.

Thus, as the retraction of the spindle assemblies 116 and 118, and the inward swinging movement of the arms 128–134 is accomplished, the gathering assembly 26 commences to retract and remove the bow from its position upon the components of the winding mechanism. The completed bow is shifted rearwardly under the urging of cylinder 162 as it drives the gathering assembly 26 toward its retracted position.

Once the completed bow has been so removed, the air cylinder 122 is again activated to thereby permit the arms 128–134 to be urged, by the illustrated spring means, to their position as shown in FIG. 9, and, likewise, the cams 196 and 198 are moved away from each other, this also permitting the arms 128–134 to swing to their initial position. As the gathering assembly 26 moves rearwardly with the completed bow held between forks 164 and 166, the forks are driven away from each other thereby to release the completed bow and permit it to drop downwardly by gravity to a point below the apparatus where it may be received in a suitable container.

In the event the bow should not drop from the forks of the gathering assembly as it is retracted, there is provided a pair of fingers 212, each of which have tines 214 extending into the apparatus at a point in the path of movement of the gathering forks 164 and 166 whereby such tines will strike the completed bow as it is carried from the winding mechanism by the gathering assembly to thereby insure that the bow is dislodged from its position within the forks 164 and 166 and dropped from the apparatus. The fingers 212 are mounted on the framework of the machine and are best illustrated in FIG. 9 of the drawings.

It will be appreciated that suitable timing mechanism, which is not illustrated, would be provided for the apparatus hereinabove described in order that the operation thereof may occur in predetermined sequence. Generally, the method of operation of the apparatus involves the following steps.

Initially, a spool of ribbon, such as 36, is placed in the ribbon carrier 34 and the free end of the ribbon manually threaded between rollers 42, which grasp the ribbon and feed it through the feeder assembly 22 until such time as the free end of the ribbon emerges out of the feeder assembly and, more particularly, through guide and drag brake assembly 66. As the free end of the ribbon moves into view of the electric eyes 70 and 72, the eyes read the fact that the ribbon is in the feeder assembly and has emerged therefrom. In its initial position, the feeder assembly 22 is at the far left end of the apparatus, viewing FIGS. 3, 4 and 9, for example, and as the free end of the ribbon emerges from the feeder assembly controls are activated to actuate power means 76 to thereby commence movement of the feeder assembly from left-to-right. The movement of the feeder assembly from its initial position activates switching means which activate the severing means 44, which is within the feeder assembly 22, to sever the length of ribbon so that a predetermined length will be permitted to be drawn from the feeder assembly by the winding mechanism 24. It should be noted that suitable control or measuring means are provided to control ribbon length by adjustment of electric eyes 70 and 72 and chute path lengths 54 and 56.

Substantially simultaneously with the cutting of the ribbon, the free end thereof which extends outwardly from the feeder assembly 22 is grasped by retaining seat 152 which sweeps thereunder upon rotation of the winding mechanism 24. The movement of the feeder assembly from its initial position activates switching means which operates the solenoid 68 on the feeder assembly whereby the rollers 62 and 64 are moved apart and drag brake 66 is activated in order that delivery of the length of ribbon from the feeder assembly may be controlled by the drag brake 66.

Once the feeder assembly moves from its initial position at the far left side of the apparatus, under the urging of power means 76, the drive screw 88 is driven, through its connection with the feeder assembly mounting plate 32, the driving of the screw causing driving movement of the countershaft 100, the power therefrom being transmitted to sprockets 112 and 114 and thence to shafts 124 and 126 whereby the winding mechanism and, more specifically, the arms 128–134, are simultaneously rotated, and the movement of the feeder assembly from left-to-right, as well as the provision of the seats 152 and 154, a helix of ribbon is laid, in extended position, about the pads 140–146, the free ends of the ribbon being retained by seats 152 and 154. Thus, the simultaneous rotation of the winding mechanism and the horizontal movement of the feeder assembly with respect thereto, ensures that an extended helix of ribbon will be created.

When the extended helix of ribbon has been created by the winding mechanism 24, and the feeder assembly has, therefore, reached the far right end of its path of travel, suitable switching means activates the gathering assembly 26, whereby to drive the carriage 160 forwardly toward the helix of ribbon and to a point where the gathering forks 164 and 166 are in alignment with the horizontal center line of the helix, as illustrated by line 158 in FIG. 9. The next operation is to activate cylinder 176 which causes the gathering forks 164 and 166 to move toward each other and thereby gather the center of the helix together. Upon completion of the gathering movement the stapler 178 is operated through tripping lever 186 to place a staple about the gathered center of the helix and to close the staple to complete the bow.

During the gathering and stapling operation, and as noted above, the pads 140–146 will tip inwardly about their pivot points 148 under the tension of the loops of the bow as it is being formed. Likewise, arms 128–134 will tend to collapse toward one another under the tension of the loops of the bow as it is being formed.

Once the bow has been gathered and stapled, the spindle assemblies 116 and 118 are retracted away from each other by operation of cylinder 122 and, likewise, cams 196 and 198 are driven toward each other simultaneously with the retraction of the spindle assemblies, all to the end that the completed bow may be released from the winding mechanism and, more particularly, from the pads 140–146 as a result of the collapsing of the arms 128–134 and the retraction of the spindle assemblies 116 and 118. The timing mechanism then causes the gathering assembly 26 to move toward a retracted position; that is, away from the winding mechanism. At substantially its fully retracted position, the gathering assembly is timed to open, that is forks 164 and 166 move away from each other, thereby permitting the ribbon to be released therefrom either by gravity or, if necessary, by contact with the tines 214 of the fingers 212.

With respect to the foregoing and particularly the wrapping of the helix of ribbon and the gathering thereof, it should be noted that the relative alignment and disposition of the arms 128–134 is such that the helix might be termed a flattened helix, that is the width front-to-back of the helix is such that it can be grasped between jaws 170 and 172 of the gathering forks 164 and 166 to thereby grasp the helix at the center thereof while yet retaining the loops of the bows about their corresponding pads 140–146.

During operation of the gathering assembly, the apparatus is being activated whereby a power means 78 in the form of an air cylinder is utilized to drive the mounting plate 32 and thereby the feeder assembly 22, from a right-to-left position viewing the drawings. As the feeder assembly is moved back to its initial position to permit commencement of another cycle of operation, the spindle assemblies are being returned to their initial positions as are the arms 128–134, it being further noted that, by virtue of the overrunning clutch 94, the winding assembly is not being rotated during the movement of the feeding assembly back to its initial position.

Obviously, suitable timing and control mechanism in the form of appropriate switching arrangement may be provided to carry out the aforementioned sequence of operation of the apparatus in order that the above described method may be carried out as rapidly as possible to create the finished bow 20 as illustrated. The bow 20, in its finished condition and as illustrated in FIG. 15 of the drawings, has four loops 216, and a pair of free ends 218, the center of the bow being secured by a staple such as 220 to tightly retain the bow in its finished condition with the loops and free ends radiating substantially equally outwardly from the staple 220.

Thus, there is presented a method and apparatus for making ribbon bows which is wholly automatic in its timed sequence of operation, and which permits the fabrication of a finished and complete bow without the necessity of manual operations, it being appreciated that once operation of the apparatus has been initiated as hereinabove described, it will continue to recycle through its sequential steps of operation until such time as the supply of ribbon upon spool 36 is exhausted, whereupon the feeder assembly may be reloaded with a new spool of ribbon and the operation of the apparatus continued.

Having thus described the invention, what is claimed as new and desired to be secured by Letters Patent is:

1. Apparatus for making a ribbon bow comprising:

a ribbon feeder assembly;

winding mechanism for receiving a length of ribbon from the feeder assembly and winding said length of ribbon into an extended helix, said winding mechanism including a plurality of simultaneously rotatable arms for receiving said length of ribbon from the feeder assembly, each of said arms having a pad swingably mounted thereon, an assembly for gathering said extended helix of ribbon at substantially the horizontal center thereof whereby to define the loops of said bow; and means for securing said loops at their point of gathering whereby to create the finished bow.

2. Apparatus as set forth in claim 1, each of said arms having its outer end connected to spindle means, said spindle means simultaneously driven simulataneously whereby to rotate said arms.

3. Apparatus as set forth in claim 2, the inner end of each arm being free and having the pad mounted thereon.

4. Apparatus as set forth in claim 3, said arms each being shiftably mounted with respect to said spindle means.

5. Apparatus as set forth in claim 4, there being cam means for shifting said arms from a first, bow-retaining position to a second, bow-releasing position.

6. Apparatus as set forth in claim 5, there being means for normally retaining said swingable pads in a substantially horizontal plane.

7. Apparatus as set forth in claim 6, there being a vacuum-operated retaining seat on certain of said arms.

8. Apparatus as set forth in claim 1, said feeder assembly being proximal to said winding mechanism whereby said length of ribbon may be fed from said feeder assembly to said winding mechanism.

9. Apparatus as set forth in claim 8, said feeder assembly being reciprocable in a horizontal path with respect to said winding mechanism.

10. Apparatus as set forth in claim 9, there being power means coupled with said feeder assembly for reciprocating the same with respect to the winding mechanism.

11. Apparatus as set forth in claim 10, there being screw means coupled with said feeder assembly and driven thereby during the reciprocation thereof, said screw means being operably connected with said winding mechanism for driving the same.

12. Apparatus as set forth in claim 1, the feeder assembly carrying a spool of ribbon and having means for delivering a length of ribbon from said spool to said winding mechanism.

13. Apparatus as set forth in claim 12, said delivery means including a chute for guiding said ribbon from said spool to said winding mechanism.

14. Apparatus as set forth in claim 13, said delivery means including driven rollers for initially urging one end of said ribbon from the feeder assembly to a point of contact with one of said arms.

15. Apparatus as set forth in claim 14, said feeder assembly having severing means therein for cutting said ribbon to a predetermined length as it is guided from said spool to the winding mechanism.

16. Apparatus as set forth in claim 1, said gathering means including a carriage disposed on the opposite side of the winding mechanism from said ribbon feeder assembly.

17. Apparatus as set forth in claim 16, said carriage carrying a pair of spaced, opposed gathering forks.

18. Apparatus as set forth in claim 17, each of said gathering forks having a pair of spaced jaws.

19. Apparatus as set forth in claim 18, said carriage being movable toward said winding mechanism, said forks being movable toward each other for gathering said extended helix of ribbon.

20. Apparatus as set forth in claim 19, said means for securing the loops at their point of gathering being carried by said carriage.

21. Apparatus as set forth in claim 20, said means being in the form of a stapler, there being means for actuating said stapler substantially simultaneously with the completion of the gathering of the extended helix by said forks.

22. Apparatus as set forth in claim 21, there being fingers positioned to remove the finished bow from said gathering forks.

23. A method of making a ribbon bow comprising the steps of:

feeding a length of ribbon from a feeder assembly to a winding mechanism;

winding said length of ribbon into an extended helix to form a plurality of contiguous spiral coils lying in spaced planes along a generally horizontal plane;

gathering said extended helix at substantially the horizontal center thereof to define the loops of the bow; and securing said loops at their point of gathering whereby to create the finished bow.

24. A method of making a ribbon bow as set forth in claim 23, including the step of controlling the rate at which said length of ribbon is fed from said feeder assembly to said winding mechanism.

25. A method of making a ribbon bow as set forth in claim 24, including the step of rotating said winding mechanism as the length of ribbon is fed thereto by the feeder assembly.

26. A method of making a ribbon bow as set forth in claim 25, including the step of discontinuing the rotation of the winding mechanism once said extended helix has been formed.

27. A method of making a ribbon bow as set forth in claim 26, including the step of gathering the extended helix during the time rotation of the winding mechanism has been discontinued.

28. A method of making a ribbon bow as set forth in claim 27, including the step of securing said loops at their point of gathering essentially simultaneously upon completion of the gathering thereof.

29. A method of making a ribbon bow as set forth in claim 28, including shifting the helix of ribbon from a first, retained position during gathering thereof into the loops of the bow to a second, bow-releasing position after the finished bow has been created.

30. A method of making a ribbon bow as set forth in claim 25, including the step of reciprocating the feeder assembly longitudinally of the winding mechanism as the length of ribbon is fed to the winding mechanism by the feeder assembly.

* * * * *